US012714223B2

(12) United States Patent
Xia et al.

(10) Patent No.: US 12,714,223 B2
(45) Date of Patent: Aug. 25, 2026

(54) TURNTABLE AND STORAGE CABINET

(71) Applicant: Ningbo Qisen Technology Co., Ltd, Ningbo (CN)

(72) Inventors: Zhuan Xia, Ningbo (CN); Meng Wang, Ningbo (CN)

(73) Assignee: Ningbo Qisen Technology Co., Ltd, Ningbo (CN)

( * ) Notice: Subject to any disclaimer, the term of this patent is extended or adjusted under 35 U.S.C. 154(b) by 179 days.

(21) Appl. No.: 18/401,700

(22) Filed: Jan. 1, 2024

(65) Prior Publication Data

US 2024/0315441 A1 Sep. 26, 2024

(30) Foreign Application Priority Data

Mar. 24, 2023 (CN) ..... 202320598483.4
Oct. 16, 2023 (CN) ..... 202322759756.1

(51) Int. Cl.
*A47B 49/00* (2006.01)

(52) U.S. Cl.
CPC ..... *A47B 49/004* (2013.01)

(58) Field of Classification Search
CPC ..... A47B 49/004; A47B 46/00; A47B 88/48; A47B 49/00; A47B 88/42; A47B 49/002; A47B 61/02; A47B 61/04; A47B 77/10; A47B 96/025; F25D 25/027; F25D 25/024
See application file for complete search history.

(56) References Cited

U.S. PATENT DOCUMENTS 535,886 A * 3/1895 Brand ..... F04D 25/08 5/96
2,647,812 A * 8/1953 Saunders ..... F25D 25/027 312/294
2,936,205 A * 5/1960 Clark ..... A47B 49/004 D15/89
4,124,262 A * 11/1978 Schill ..... A47B 49/004 312/307
4,659,050 A * 4/1987 Tabayashi ..... F16C 33/588 248/349.1
4,959,582 A * 9/1990 Meyer ..... A47B 49/00 312/307
9,022,495 B1 * 5/2015 Conner, Sr. ..... A47F 3/08 312/238
9,528,753 B1 * 12/2016 Conner, Sr. ..... F25D 25/02
2002/0117943 A1 * 8/2002 Gerkey ..... A47B 96/025 312/238

(Continued)

*Primary Examiner* — Hiwot E Tefera

(57) ABSTRACT

A turn table includes a tray with heart-shaped and straight sliding rails and a base with first and second rods, wherein the first rod is slidably matched with the heart-shaped sliding rail, and the second rod is slidably matched with the straight sliding rail. When the tray is at an initial position, symmetrical lines of the bottom of the tray and the heart-shaped sliding rail are collinear, and the straight sliding rail extends along the symmetrical line of the heart-shaped sliding rail. When the tray switches from the initial position to a picking position, the first rod slides along the heart-shaped sliding rail and the second rod slides along the straight sliding rail, making the tray rotate circumferentially relative to the base with an outer circumferential surface thereof being prevented from interfering with an inner wall of a chamber for placing the turntable and thus accommodating the tray therein.

12 Claims, 12 Drawing Sheets

(56) References Cited

U.S. PATENT DOCUMENTS

| | | | | |
|---|---|---|---|---|
| 2006/0163984 | A1* | 7/2006 | Andersen | A47F 3/06 312/401 |
| 2019/0104844 | A1* | 4/2019 | Garrett | A47B 88/41 |
| 2020/0018349 | A1* | 1/2020 | Rehage | A47B 77/10 |
| 2020/0170408 | A1* | 6/2020 | Rehage | A47B 49/004 |
| 2020/0187641 | A1* | 6/2020 | Rehage | F25D 25/027 |
| 2020/0191471 | A1* | 6/2020 | Rehage | F25D 25/027 |
| 2021/0156609 | A1* | 5/2021 | Rehage | F25D 25/02 |
| 2021/0227974 | A1* | 7/2021 | Rehage | A47B 96/025 |
| 2022/0225763 | A1* | 7/2022 | Rehage | A47B 49/004 |

* cited by examiner

TURNTABLE AND STORAGE CABINET

CROSS-REFERENCE TO RELATED APPLICATIONS

The present application claims priorities of Chinese Patent Application No. 202320598483.4, filed on Mar. 24, 2023 and Chinese Patent Application No. 202322759756.1, filed on Oct. 16, 2023, the entire contents of which are hereby incorporated by reference.

TECHNICAL FIELD

The present application relates to the technical field of daily necessities, and in particular to a turntable and a storage cabinet.

BACKGROUND

It is a common way to improve a storage capacity of a storage chamber, such as cabinet, refrigerator and the like, by setting a plurality of partitions therein. An internal space of the storage chamber is separated into multiple layers by the partitions, and thus can be more effectively utilized to prevent space waste. However, such construction makes a height between adjacent partitions be limited, especially after certain items are placed. Users need to first remove the items placed at a front side before they can get the items placed at a rear side, and they further need to put the items at the front side back in place, which is very inconvenient in practical use.

The present application takes a refrigerator as an example to illustrate the storage cabinet, which is also applicable to other storage devices with multiple layers, such as cabinets and the like. Technical solutions are proposed to set a turntable on the partition to store items thereon, thereby utilizing the turntable to rotate required items to the front side for retrieval. For example, Chinese Patent Publication No. CN 105571262A discloses a rotatable refrigerator partition, which adds a rotary partition in a center of an ordinary partition. For items in the deep part of the refrigerator, quick and effective retrieval operations can be achieved by moving a stirring piece. However, the storage chamber inside the refrigerator is generally rectangular-shaped, and circular-shaped partition used in the rectangular-shaped storage chamber will undoubtedly cause space waste. Further, rectangular-shaped partition with suitable dimensions will collide with an inner wall of the refrigerator during its rotation, making it difficult to complete the rotation.

For the above issues, Chinese Patent Publication No. CN 115218588A discloses a refrigerator including a case body and a tray assembly. A refrigeration chamber with an opening defined at a front side is formed in the case body, and the tray assembly is located inside the refrigeration chamber. The tray assembly includes a base plate and a tray arranged on the base plate. The tray is configured to be rotatably connected to the base plate and slidably relative to the base plate in a horizontal plane during its rotation, thereby driving the tray to move forwards relative to the case body, and thus edges of the tray in the left-right direction being able to pass through a front of a rear side wall of the refrigeration chamber. That is, the tray is prevented from interfering with the rear side wall of the refrigeration chamber during its rotation, and the rear side of the tray can be rotated to the front side.

In this technical solution, as shown in FIG. 1 to FIG. 3 (FIG. 1 is placed transversely and FIG. 3 is placed longitudinally), by means of setting multiple sliding rails and rotating shafts which cooperate with each other, the tray can move forward during its rotation to avoid the inner wall of the case body, solving the problems of wasting space for the circular partition and unable to rotate for the rectangular partition. However, the tray assembly, which is constructed by multiple sliding rails and rotating shafts, is too complex in structure, making production difficult and requiring high accuracy. Furthermore, any jamming of the rotating shaft during rotation will make the tray assembly unable to rotate. Multiple sliding rails and rotating shafts will increase the probability of jamming, finally affecting normal use.

SUMMARY

An object of the present application is to provide a turntable and a storage cabinet including the turntable, which makes a tray thereof rotate normally by setting a heart-shaped sliding rail and a straight sliding rail on a base thereof, simplifying the structure and ensuring smooth use.

In order to achieve the above object, an embodiment of the present application provides a turntable that includes a base and a tray. A heart-shaped sliding rail and a straight sliding rail are provided on the base, wherein the heart-shaped sliding rail surrounds the straight sliding rail. A first rod and a second rod are provided on a bottom of the tray and arranged on a symmetrical line of the bottom of the tray, wherein the first rod is slidably matched with the heart-shaped sliding rail, and the second rod is slidably matched with the straight sliding rail. When a position of the tray relative to the base is at an initial position, the symmetrical line of the bottom of the tray is collinear with a symmetrical line of the heart-shaped sliding rail, and the straight sliding rail extends along the symmetrical line of the heart-shaped sliding rail. When the position of the tray relative to the base switches from the initial position to a picking position, the first rod slides along the heart-shaped sliding rail and the second rod slides along the straight sliding rail, making the tray rotate circumferentially relative to the base with an outer circumferential surface of the tray being prevented from interfering with an inner wall of a chamber which is configured for placing the turntable and thus accommodating the tray therein.

In this embodiment, the chamber for placing the turntable and accommodating the tray includes but is not limited to an inner chamber of the refrigerator, an inner chamber of the cabinet. Such chambers are generally rectangular-shaped, with limited height and large depth. When certain items are placed in the inner chamber, it is difficult to directly get the items placed at the inner side. By means of setting the turntable on which the items are placed, the items at the inner side can be rotated to the outer side for easy retrieval by rotating the tray. For fitting such rectangular-shaped inner chamber, the tray according to the present application is generally rectangular-shaped, and has a length in the left-right direction being greater than that in the front-rear direction. Compared with the circular-shaped tray, the present tray is able to accommodate more items. In this application, the initial position refers to a position of the tray that it is placed transversely on the base and not rotating, while the picking position refers to a position of the tray that it is rotated relative to the base and convenient for users to get the items. By means of setting the first and second rods which are arranged on the symmetry line of the bottom of the tray, the symmetry lines of the tray, the heart-shaped sliding rail and the straight sliding rail, the first rod and the second rod are located on the same line when the tray is at the initial position. When the position of the tray relative to the base switches from the initial position to the picking position, that is, when the user rotates the tray, a center of gravity of the tray is always located on the straight sliding rail, and thus rotation of the tray is stable and reliable. Through the cooperation between the heart-shaped sliding rail and the straight sliding rail, the tray can continuously adjust its position on the base, so that the outer circumferential wall of the tray can avoid the inner wall of the chamber, and a gap is always existed between the outer circumferential wall of the tray and the inner wall of the chamber. Accordingly, the tray does not collide with the inner wall of the chamber during its rotation. In this embodiment, the turntable can achieve 3600 rotation of the tray on the base without colliding with the inner wall of the chamber through only two sliding rails, which is simpler in structure compared to that with multiple sliding rails, reducing production difficulty and cost. Furthermore, the probability of jamming of two sliding rails is smaller, and thus the tray rotates more smoothly.

Further, in some embodiments, the heart-shaped sliding rail is a concaved groove defined in the base, and the straight sliding rail is an elongated, strip-shaped through hole defined in the base.

In this embodiment, the heart-shaped sliding rail is configured as concaved groove and the straight sliding rail is configured as elongated, strip-shaped through hole. When the tray needs to be installed on the base, the first rod can be aligned with and inserted into the heart-shaped sliding rail, and the second rod can be aligned with and inserted into the straight sliding rail. Further, as the straight sliding rail is constructed as through hole, the second rod can be fixed inside the straight sliding rail after passing through the through hole, simplifying the assembly steps.

Further, in some embodiments, the second rod extends through the straight sliding rail to connect a limiting member, and the limiting member cooperates with the straight sliding rail to keep the second rod within the straight sliding rail.

In this embodiment, the second rod is limited in the straight sliding rail by the limiting member connected thereto, which makes the tray be positioned relative to base in the up and down direction, the tray is thus prevented from disengaging from the base and accordingly the rotary stability of the tray is improved. In addition, the second rod is able to extend through the straight sliding rail to connect the limiting member, which is simple and labor-saving.

Further, in some embodiments, a bottom of the straight sliding rail is provided with a circumferential surface that matches with the limiting member, and the circumferential surface abuts a bottom of the limiting member.

In this embodiment, by means of setting the circumferential surface at the bottom of the straight sliding rail, the straight sliding rail abuts the bottom of the limiting member through the circumferential surface, so that the limiting member is unable to totally pass through the straight sliding rail. The top of the limiting member passes through the bottom of the straight sliding rail to connect the bottom of the second rod, and the bottom of the limiting member abuts the circumferential surface, so that the second rod is limited within the straight sliding rail. During sliding of the second rod relative to the straight sliding rail, the bottom of the limiting member also slides relative to the circumferential surface, which improves the tight fit between the second rod and the limiting member and makes it less prone to wear during the sliding.

Further, in some embodiments, a plurality of rolling balls is provided between the tray and the base. In this embodiment, the tray rotates relative to the base, and by means of setting the rolling balls between the tray and the base, the tray rotates more smoothly and quickly through rolling cooperation, resulting in higher rotation efficiency.

Further, in some embodiments, the base is provided with a plurality of ball seats, and the plurality of rolling balls are mounted in the plurality of ball seats, respectively. In this embodiment, by means of setting ball seats on the base to install the rolling balls, the structure is simple and the rotational stability is better.

Further, in some embodiments, the straight sliding rail is provided with a limiting end, and the second rod is located at the limiting end when the position of the tray relative to the base is at the initial position. In this embodiment, the tray moves forward and backward by sliding of the second rod along the straight sliding rail. One end of the straight sliding rail is set as the limiting end, when the position of tray relative to the base is at the initial position, the second rod is at the limiting end. At this time, the second rod cooperates with the limiting end to prevent the tray from being pulled forwards, so that the tray merely can be rotated, improving tensile performance.

Further, in some embodiments, a bottom surface of the base is concaved upwards to form a concave portion, the heart-shaped sliding rail is located within the concave portion, and a plurality of reinforced structures is provided on the concave portion and connected to the heart-shaped sliding rail.

In this embodiment, the base is configured to form a concave portion with an upward depression, and is placed longitudinally in the chamber by lateral walls of the bottom surface of the base. The heart-shaped sliding rail is a concaved groove defined in the base, and is located in the concave portion and is a convex structure inside the concave portion, which can reduce the weight of the base. Furthermore, the heart-shaped sliding rail is connected to the reinforced structures, which reduces the weight of the base while also ensuring the strength of the heart-shaped sliding rail.

Further, in some embodiments, a sucker is provided at the bottom of the base. In this embodiment, the turntable is mainly installed in the inner chamber of the refrigerator or cabinet which has already partitions placed therein. By means of setting the sucker on the base, the turntable can be connected to the partition through the sucker when installed on the partition, such fixing structure is simple, stable and reliable.

Further, in some embodiments, the sucker is provided with a handle, and an opening that matches with the handle is provided at the bottom of the base, and wherein the handle extends beyond the base through the opening. In this embodiment, the handle extends beyond the base through the opening. When the turntable needs to be removed from the partition, the user can easily detach the sucker from the partition by pulling the handle located out of the base, thereby enabling the turntable to be removed, which is convenient and labor-saving in use.

Further, in some embodiments, a first bearing is provided between the first rod and the heart-shaped sliding rail, and the first rod slides inside the heart-shaped sliding rail through the first bearing; and a second bearing is provided between the second rod and the straight sliding rail, and the second rod slides inside the straight sliding rail through the second bearing.

In this embodiment, the first bearing is mounted around the end of the first rod, and thus the first rod slides more smoothly through the first bearing, improving sliding efficiency; the second bearing is mounted around the end of the second rod, and thus the second rod slides more smoothly through the second bearing, improving sliding efficiency and enhancing user experience.

Further, in some embodiments, an anti-slip structure is formed on an outer surface of the tray. In this embodiment, the tray is mainly used for storing items. By means of setting the anti-slip structure on the outer surface of the tray, the items are not easy to slide after being placed on the tray, improving placement stability and safety.

Further, in some embodiments, a head and a tail of the heart-shaped sliding rail each are provided with a flat section that matches with the first rod; and/or, two sides of the heart-shaped sliding rail each are provided with a concave section that matches with the first rod; and/or, the head and the tail of the heart-shaped sliding rail each are provided with a position structure that matches with the first rod. In this embodiment, the tray can continuously rotate and adjust its position on the base through the cooperation between the first rod and the heart-shaped sliding rail, the straight sliding rail. The sliding of the first rod is relatively smooth and not easy to jam by setting flat sections at the head and tail of the heart-shaped sliding rail. Furthermore, by means of setting the position structures at the head and tail of the heart-shaped sliding rail, when the first rod slides to the head/tail of the heart-shaped sliding rail, it facilitates position of the tray when the tray is transversely placed on to the base, which is beneficial for improving the user experience. Moreover, the concave section is conducive to position of the tray when it is longitudinally positioned relative to the base, further improving the user experience.

Further, in some embodiments, the present application provides a refrigerator including the turntable as described above. The turntable is installed in the refrigerator, and users can store items on the turntable. By rotating the tray, the items placed at the back side can be rotated to the front side for retrieval. Users can get the items by a single handle, which is labor-saving and convenient to use.

Figure 1:
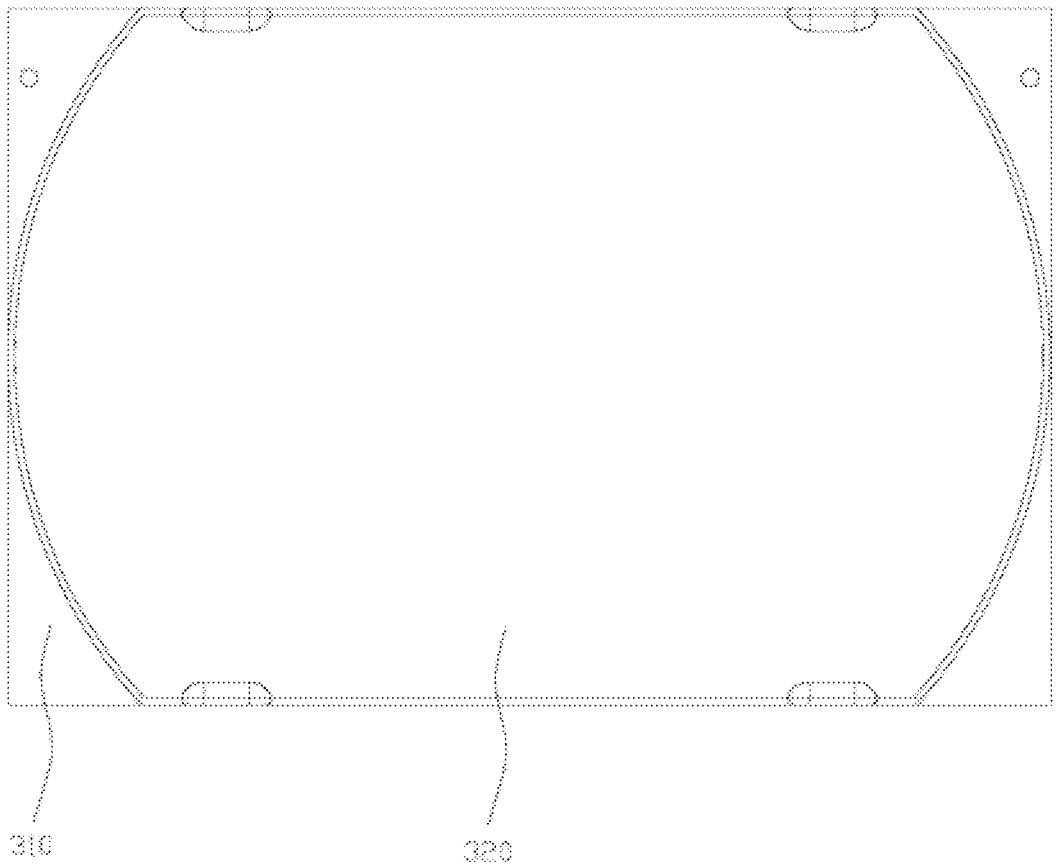
FIG. 1 is a schematic view of a tray and a base according to a refrigerator described in the background, wherein a position of the tray relative to the base is at an initial position.

310, base plate; 320, tray.

In the figures of this application:

1, tray; 11, first rod; 12, second rod; 13, anti-slip structure;
2, base; 21, heart-shaped sliding rail; 211, flat section; 212, position structure; 213, concave section; 22, straight sliding rail; 221, circumferential surface; 222, limiting end; 23, ball seat; 24, concave portion; 25, reinforced structure; 26, opening;
3, first bearing; 4, second bearing; 5, sucker; 51, handle; 6, limiting member.

DESCRIPTION OF THE EMBODIMENTS

In order to make those skilled in the art better understand the present application, technical solutions in the embodiments of the present application will be clearly and completely described below with reference to accompanying drawings in the embodiments of the present application. It should be understood that these detailed description are only for exemplary embodiments of the present application, and are not intended to limit the scope of the present application in any way. In the whole specification, the same reference numerals refer to the same components.

In the accompanying drawings, for facilitating description, the thicknesses, sizes, and shapes of the objects have been slightly exaggerated. The accompanying drawings are only examples and not strictly drawn to scale.

It should also be understood that terms "include/includes/including" "comprise/comprised/comprising" and "have/has/having" used in this specification indicate the existence of the described features, devices, steps, processes, elements, and/or components, but do not exclude the existence or attachment of one or more other features, devices, steps, processes, elements, components and/or combinations of them.

As shown in FIG. 4 to FIG. 10, the present application discloses a turntable that includes a tray 1 and a base 2, wherein the tray 1 is rotatably mounted on the base 2. The tray 1 is generally rectangular-shaped, and has a length in left-right direction greater than that in front-rear direction. The turntable is mainly used in a storage device which has an inner chamber with a plurality of layers of partitions. The storage device includes but is not limited to refrigerator and cabinet, and its inner chamber is generally rectangular-shaped. A height of the inner chamber is limited but a depth of the inner chamber is large. The tray 1 according to this embodiment is generally rectangular-shaped and more suitable for such rectangular-shaped inner chamber. When certain items are placed in the inner chamber, it is difficult to directly get the items located at an inner side. By means of setting the turntable on which the items are arranged, the items at the inner side can be rotated to an outer side by rotating the tray 1, so that the items at the inner side are easy to get.

Figure 2:
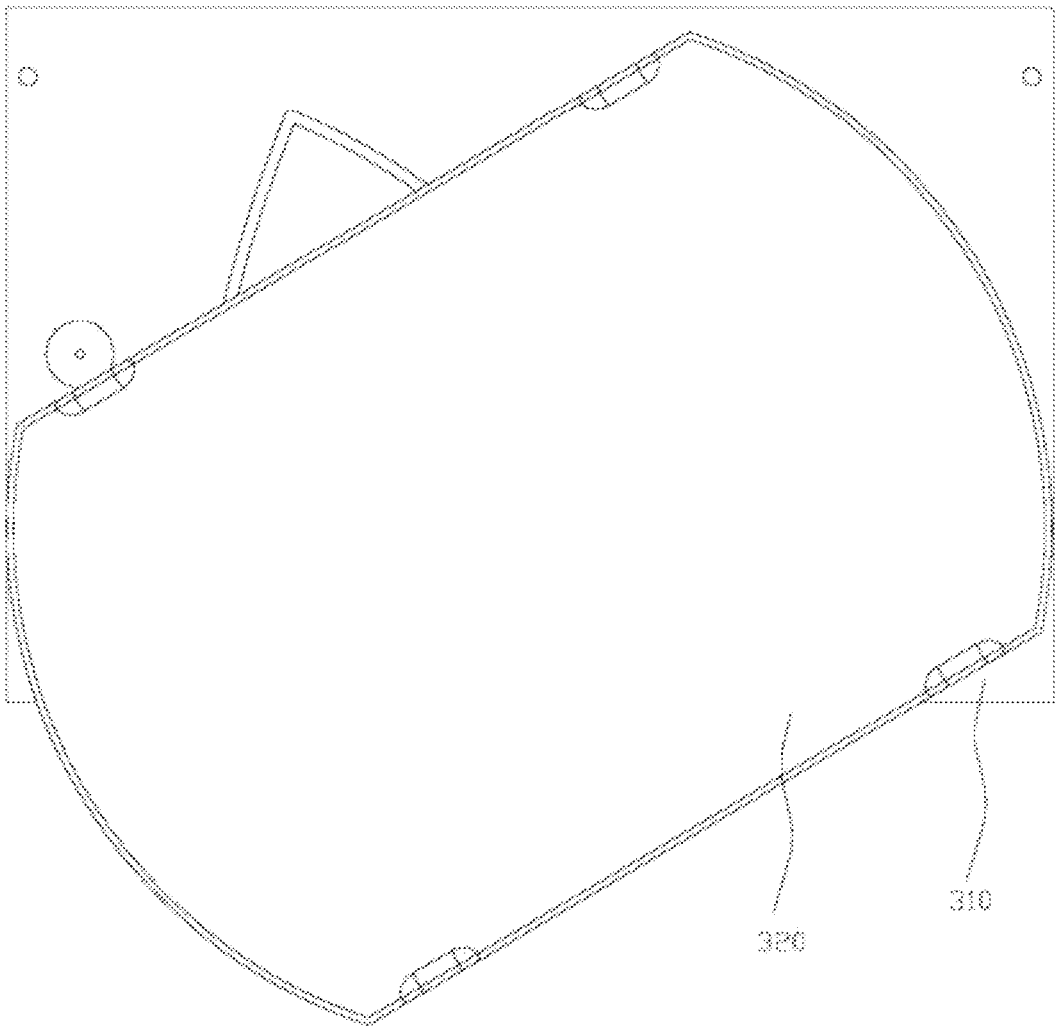
FIG. 2 is a schematic view of a tray and a base according to a refrigerator described in the background, wherein the tray moves forwards on the base.
Figure 3:
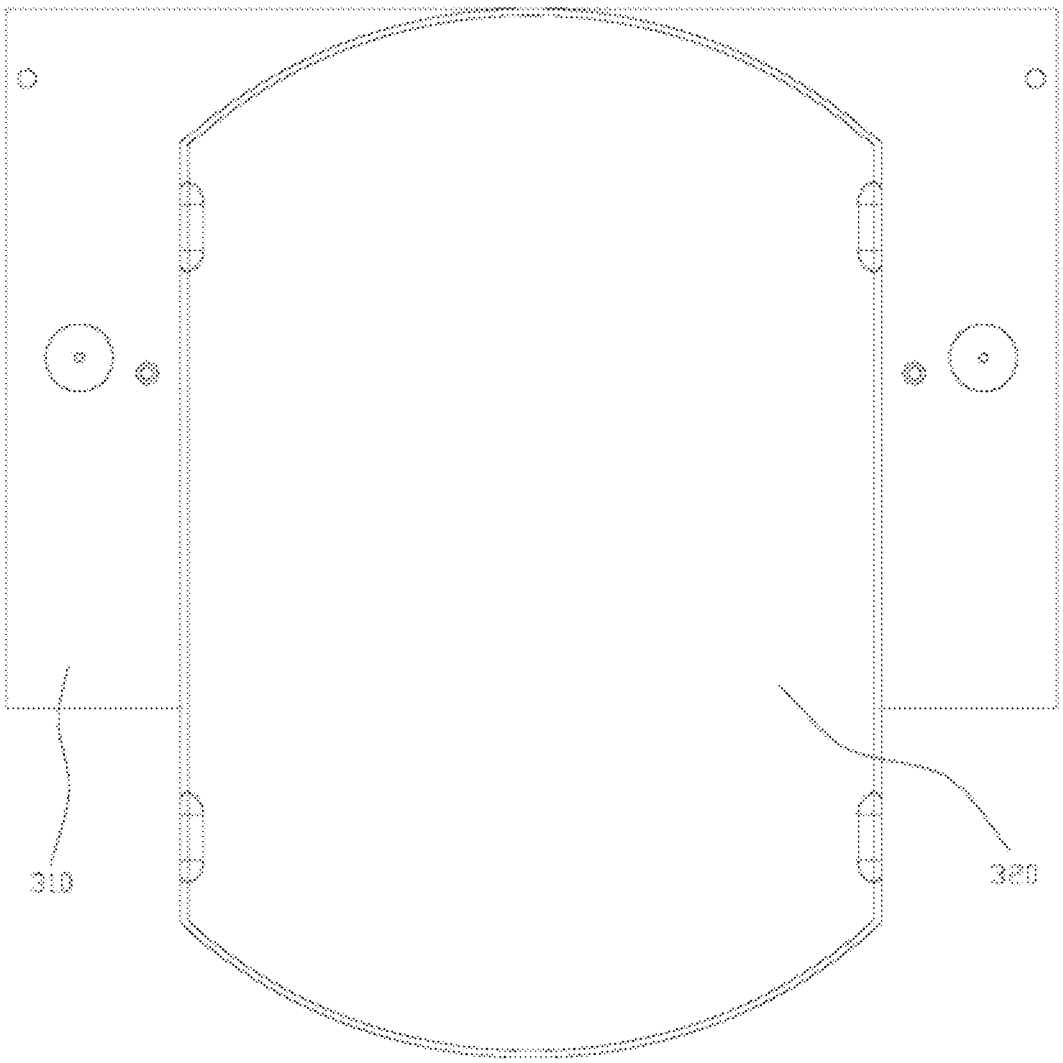
FIG. 3 is a schematic view of a tray and a base according to a refrigerator described in the background, wherein the tray rotates on the base.
Figure 5:
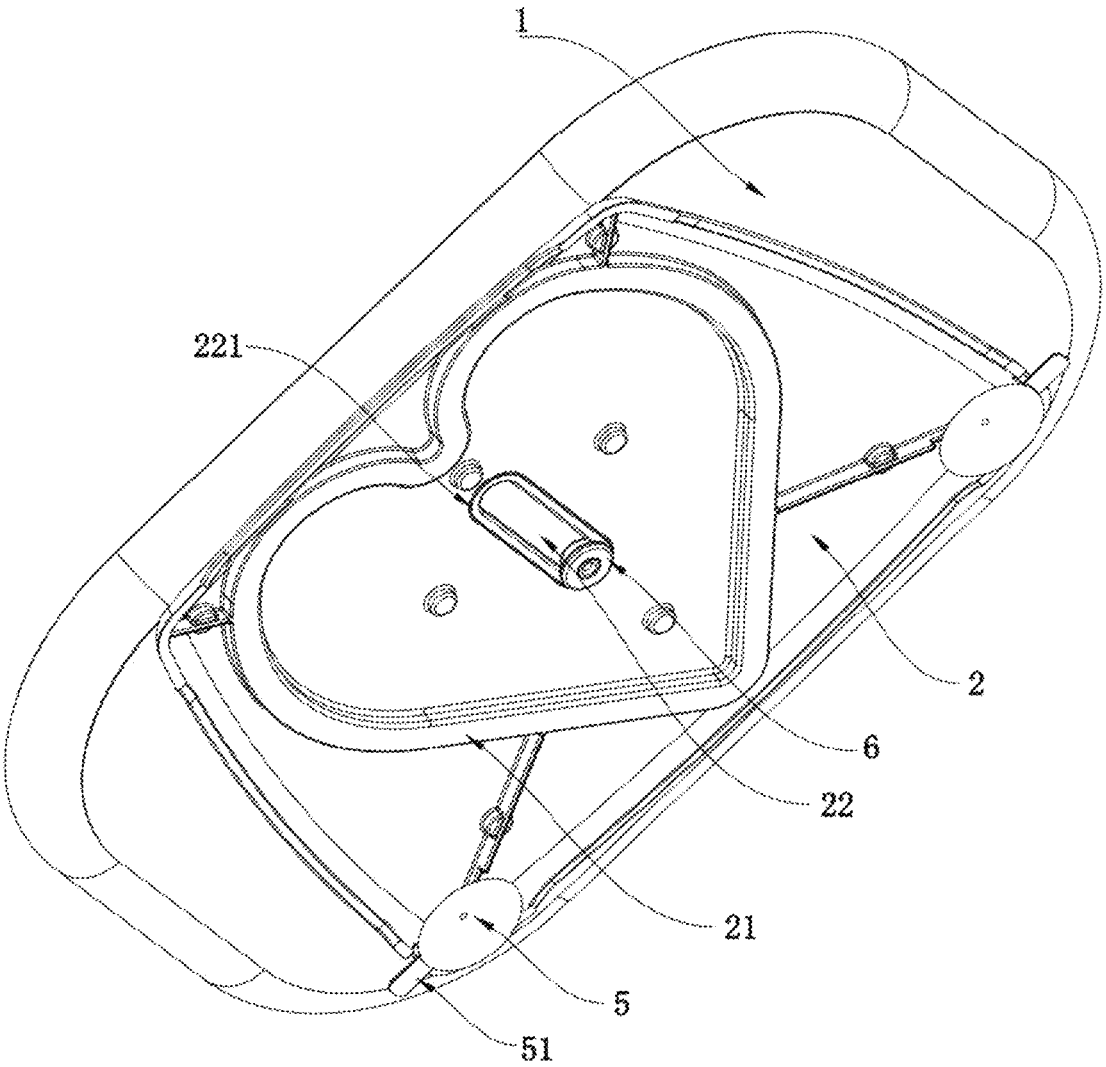
FIG. 5 shows the turntable from another aspect.
Figure 6:
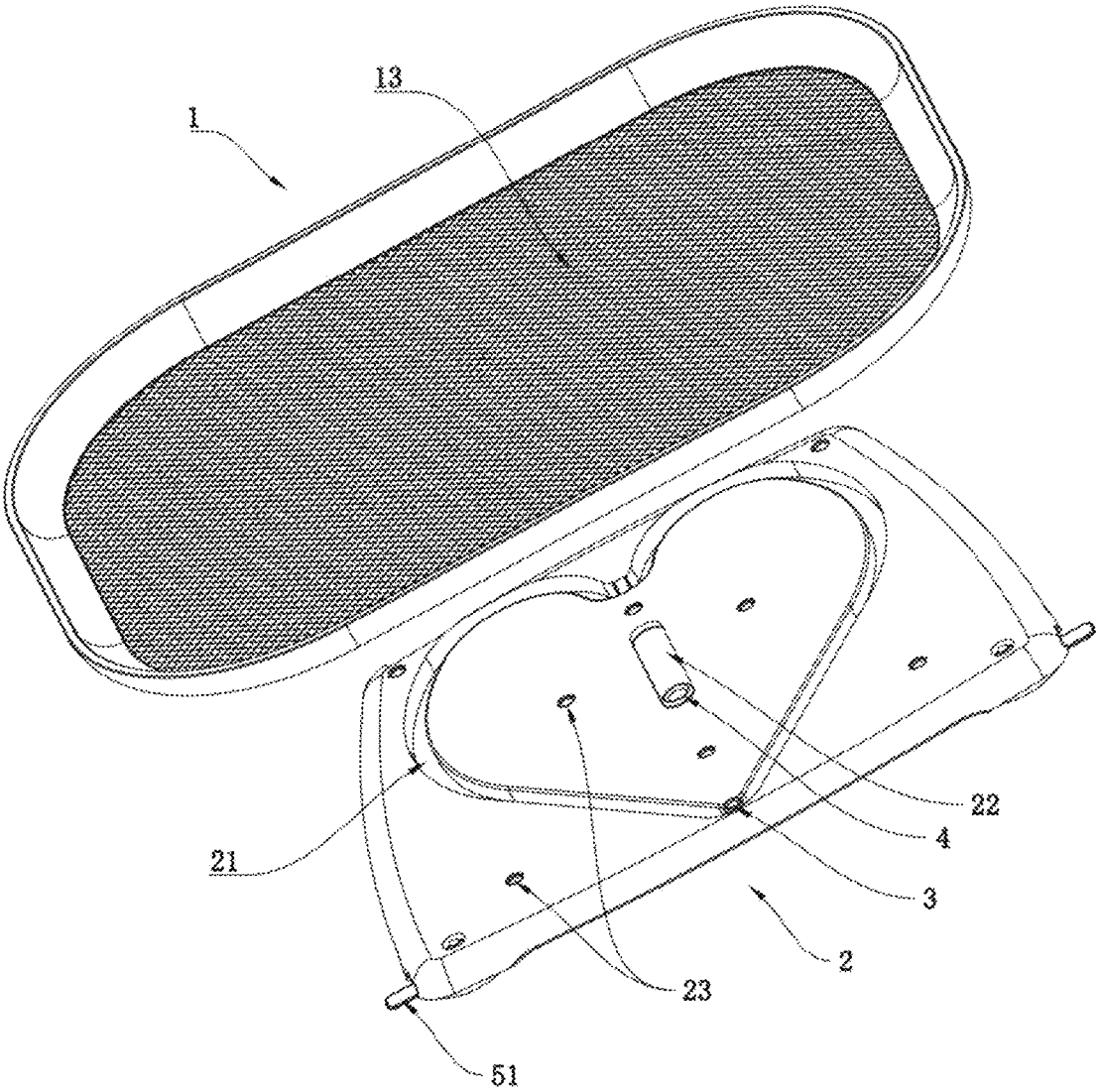
FIG. 6 is an exploded view of the turntable.
Figure 7:
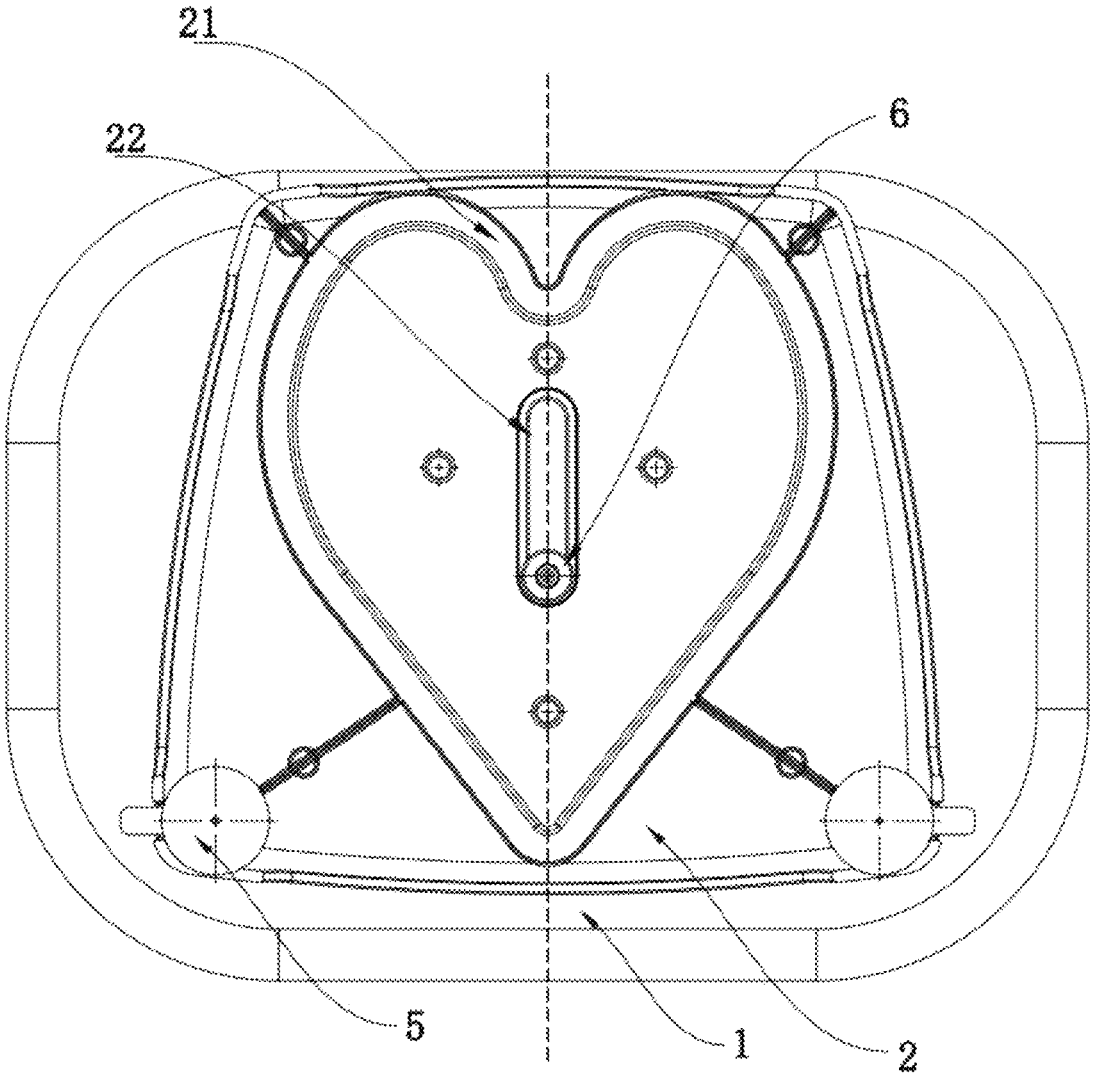
FIG. 7 is a bottom plan view of the turntable.

As shown in FIG. 5 to FIG. 10, the base 2 is provided with a heart-shaped sliding rail 21 and a straight sliding rail 22, wherein the straight sliding rail 22 is surrounded by the heart-shaped sliding rail 21. The straight sliding rail 22 is centered on the base 2, and a bottom of the tray 1 is provided with a first rod 11 and a second rod 12 which are distributed on a symmetrical line of the bottom of the tray 1. When a position of the tray 1 relative to the base 2 is at an initial position, as shown in FIG. 1 and FIG. 7, the symmetrical line of the bottom of the tray 1 is collinear with a symmetrical line of the heart-shaped sliding rail 21, and the straight sliding rail 22 extends along the symmetrical line of the heart-shaped sliding rail 21, wherein the initial position refers to a position of the tray 1 that it is placed transversely on the base and not rotating. That is, at the initial position, the symmetrical lines of the tray 1, the heart-shaped sliding rail 21 and the straight sliding rail 22, the first rod 11, and the second rod 12 are all located on a same line, i.e., a dashed line shown in FIG. 7. The first rod 11 is slidably matched with the heart-shaped sliding rail 21, and the second rod 12 is slidably matched with the straight sliding rail 22. When the position of the tray 1 relative to the base 2 switches from the initial position to a picking position, that is, the tray 1 is rotated by the user, the first rod 11 slides along the heart-shaped sliding rail 21 and the second rod 12 slides along the straight sliding rail 22, wherein the picking position refers to a position where the tray 1 is rotated relative to the base 2 to facilitate the user to get the items. A center of gravity of the tray 1 is always located on the straight sliding rail 22, and thus rotation of the tray 1 is stable and reliable. Through the cooperation of the heart-shaped sliding rail 21 and the straight sliding rail 22, the tray 1 can continuously adjust its position on the base 2. As shown in FIG. 1 to FIG. 3, an outer circumferential wall of the tray 1 can avoid an inner wall of the chamber, so that the rotary tray 1 does not collide with the inner wall of the chamber.

On the other hand, when the user rotates the tray 1, the first rod 11 slides along the heart-shaped sliding rail 21 and the second rod 12 slides along the straight sliding rail 22. The first rod 11 and the second rod 12 are fixed at the bottom of the tray 1, and thus a distance between the first rod 11 and the second rod 12 can not change. Rotation of the tray 1 relative to the base 2 is always achieved by sliding of the two fixed rods 11, 12 within the corresponding sliding rails 21, 22. The rotation of the tray 1 on the base 2 achieved by cooperation of double rods and double sliding rails is not loose, resulting in better rotational efficiency. Furthermore, the turntable can achieve 360° rotation of the tray 1 on the base 2 without colliding with the inner wall of the chamber through only two sliding rails 21, 22 and two rods 11, 12, it is simpler in structure compared to that with multiple sliding rails, reducing production difficulty and cost. Moreover, the probability of jamming of the two sliding rails is smaller, and thus the tray 1 rotates more smoothly.

Figure 8:
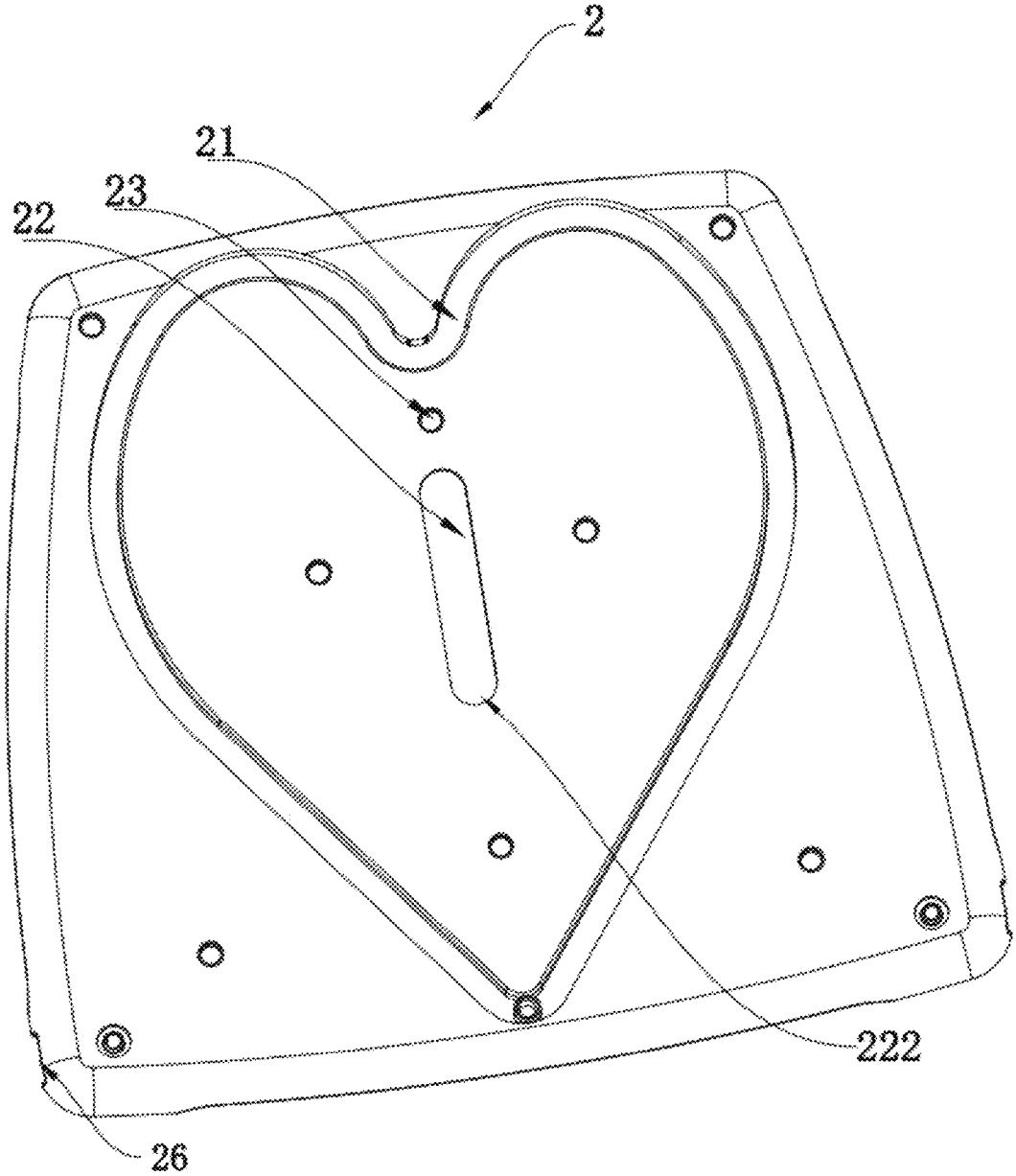
FIG. 8 is a schematic view of a base of the turntable according an embodiment of the present application, viewed from a top side.

As shown in FIG. 5 and FIG. 8, the heart-shaped sliding rail 21 is a concaved groove defined in the base 2, and the straight sliding rail 22 is an elongated, strip-shaped through hole defined in the base 2. When the tray 1 needs to be installed on the base 2, the first rod 11 can be aligned with and inserted into the heart-shaped sliding rail 21, and the second rod 12 can be aligned with and inserted into the straight line sliding rail 22. As the straight sliding rail 22 is a through hole, the second rod 12, which passes through the straight sliding rail 22, can be connected to a limiting member 6. The second rod 12 can be kept within the straight sliding rail 22 by the connected limiting member 6, so that the tray 1 is positioned relative to base 2 in the up and down direction, which can prevent the tray 1 from disengaging from the base 2, and the stability of the rotary tray 1 is also better. In addition, the second rod 12 can extend through the straight sliding rail 22 to connect the limiting member 6, such fixing structure is simple and labor-saving, simplifying the assembly steps. It should be noted that the limiting member 6 in this embodiment includes but is not limited to nuts, bolts.

Figure 9:
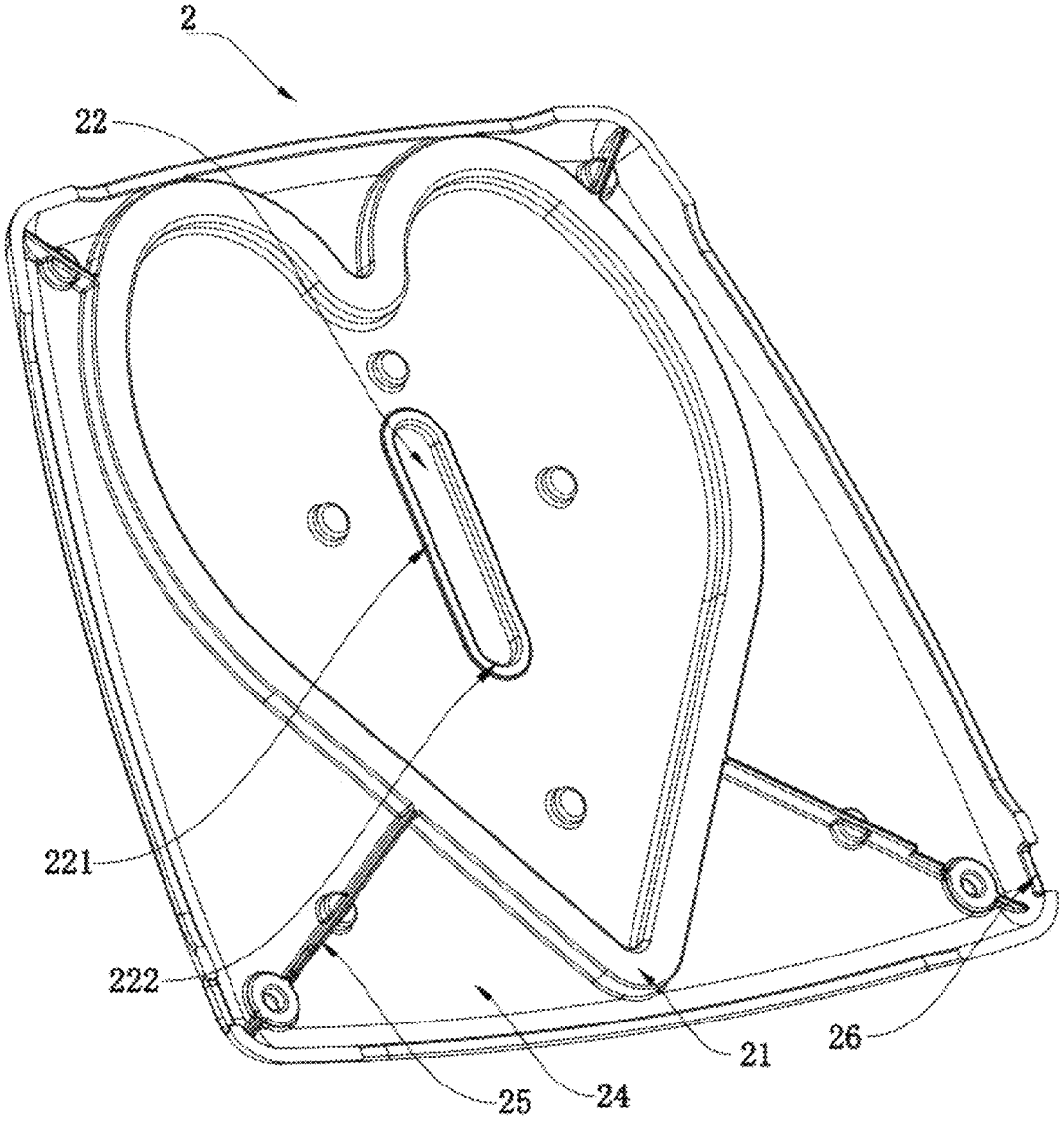
FIG. 9 is a schematic view of the base, viewed from a bottom side.
Figure 10:
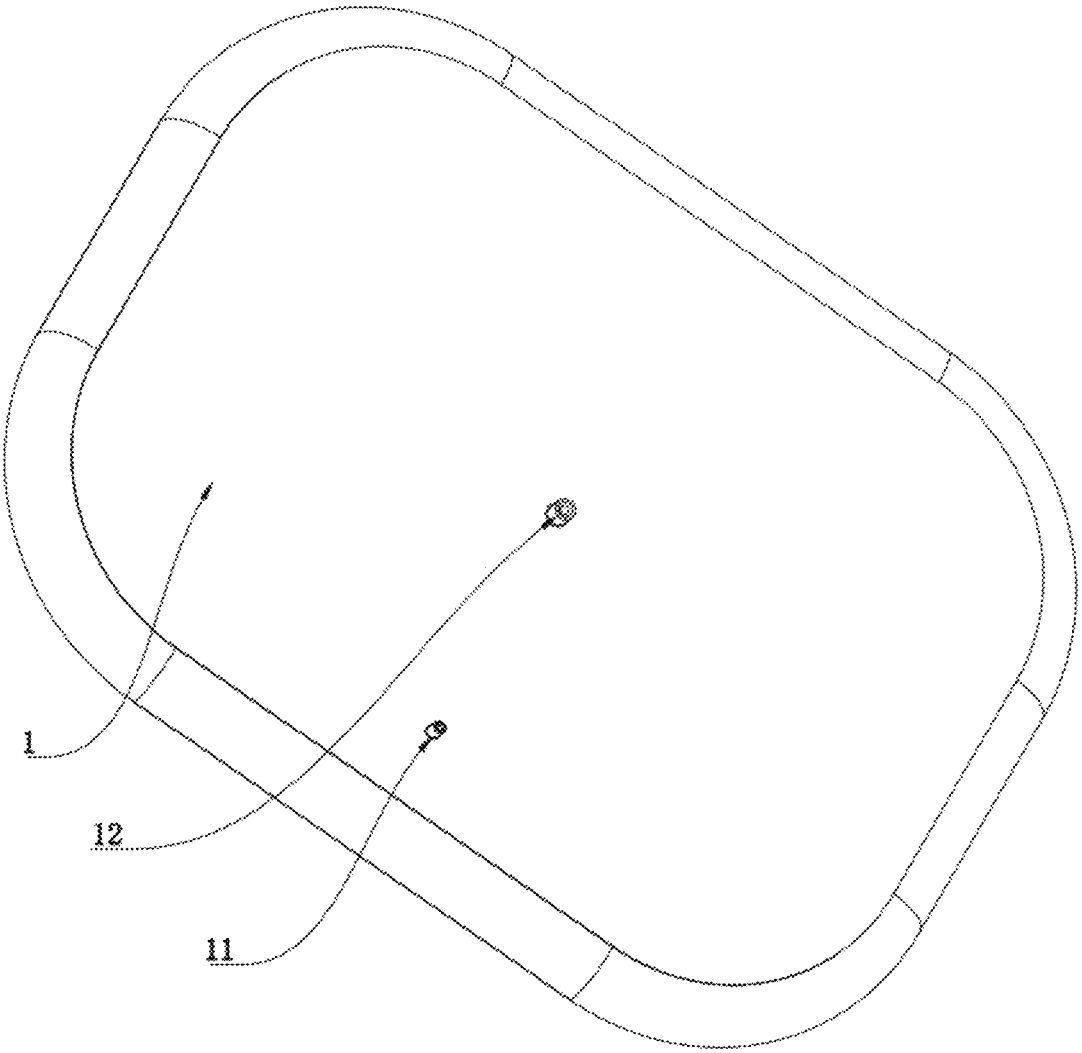
FIG. 10 is a schematic view of a tray of the turntable according an embodiment of the present application, viewed from a bottom side.

More specifically, as shown in FIG. 5, FIG. 7, and FIG. 9, a bottom of the straight sliding rail 22 is provided with a circumferential surface 221 that is adapted to the limiting member 6. The straight sliding rail 22 abuts a bottom of the limiting member 6 at the circumferential surface 221, making it impossible for the whole limiting member 6 to pass through the straight sliding rail 22. A top of the limiting member 6 passes through the straight sliding rail 22 and is connected to a bottom of the second rod 12, and the bottom of the limiting member 6 abuts against the circumferential surface 221 to achieve position limit, making the second rod 12 be limited within the straight sliding rail 22. During sliding of the second rod 12 relative to the straight sliding rail 22, the bottom of the limiting member 6 also slides relative to the circumferential surface 221. Through the circumferential surface 221, a tight fit between the second rod 12 and the limiting member 6 is better, and the limiting member 6 is not easily worn during the sliding.

As shown in FIG. 6 and FIG. 8, a plurality of rolling balls is provided between the tray 1 and the base 2, and a plurality of ball seats 23 is provided on base 2, wherein the rolling balls are mounted into the ball seats 23, respectively. When the tray 1 is rotated by the user, it rotates more smoothly and quickly for rolling cooperation of the rolling balls, and a rotational efficiency is thus higher. By means of setting ball seats 23 on the base 2 to accommodate rolling balls, the structure is simple and the rotational stability is better.

As shown in FIG. 5 to FIG. 9, the straight sliding rail 22 is provided with a limiting end 222. The ray 1 moves forward and backward to change its position in the front-rear direction by sliding of the second rod 12 along the straight sliding rail 22. By means of setting one end of the straight sliding rail 22 as the limiting end 222, the second rod 12 is at the limiting end 222 when the position of the ray 1 relative to the base 2 is at the initial position. At this time, the second rod 12 cooperates with the limiting end 222 to prevent the tray 1 from being pulled forwards, so that the tray 1 can only be rotated, improving a tensile performance.

As shown in FIG. 9, a bottom surface of the base 2 is concaved upwards to form a concave portion 24. The base 2 is placed longitudinally in the chamber by lateral walls of the bottom surface of the base 2. The heart-shaped sliding rail 21 is a concaved groove defined in the base 2, and is located inside the concave portion 24 and is a convex structure within the concave portion 24, which can reduce a weight of the base 2. Furthermore, the concave portion 24 is provided with a plurality of reinforced structures 25, and the reinforced structures 25 are connected to the heart-shaped sliding rail 21, making the weight of the base 2 be reduced while a strength of the heart-shaped sliding rail 21 be ensured.

As shown in FIG. 5 to FIG. 9, several suckers 5 are provided at the bottom of base 2. The turntable is mainly installed in the inner chamber of the refrigerator or cabinet which has been already equipped with partitions. By means of setting the suckers 5 on base 2, the turntable can be connected to the partition through the suckers 5 when it is installed on the partition. Such fixing structure is simple, stable and reliable.

As shown in FIG. 5 to FIG. 9, more specifically, the sucker 5 is provided with a handle 51, and the bottom of the base 2 is provided with an opening 26 that is suitable for the handle 51. The handle 51 extends beyond the base 2 through the opening 26. When the turntable needs to be removed from the partition, the user can easily detach the sucker 5 from the partition by pulling the handle 51 located out of the base 2, so that the turntable can be removed, which is convenient and labor-saving in use.

As shown in FIG. 6, a first bearing 3 is arranged between the first rod 11 and the heart-shaped sliding rail 21. The first bearing 3 is mounted around an end of the first rod 11, and the first rod 11 slides inside the heart-shaped sliding rail 21 through the first bearing 3, making the sliding be smoother and improving the sliding efficiency. A second bearing 4 is arranged between the second rod 12 and the straight sliding rail 22. The second bearing 4 is mounted at an end of the second rod 12, and the second rod 12 slides inside the linear slide 22 through the second bearing 4, making the sliding be smoother, improving the sliding efficiency and user experience.

It should be noted that, in this embodiment, the limiting member 6 and the second bearing 44 may be integrally formed as one piece or may be formed separately and then assembled together, which is not limited.

Figure 4:
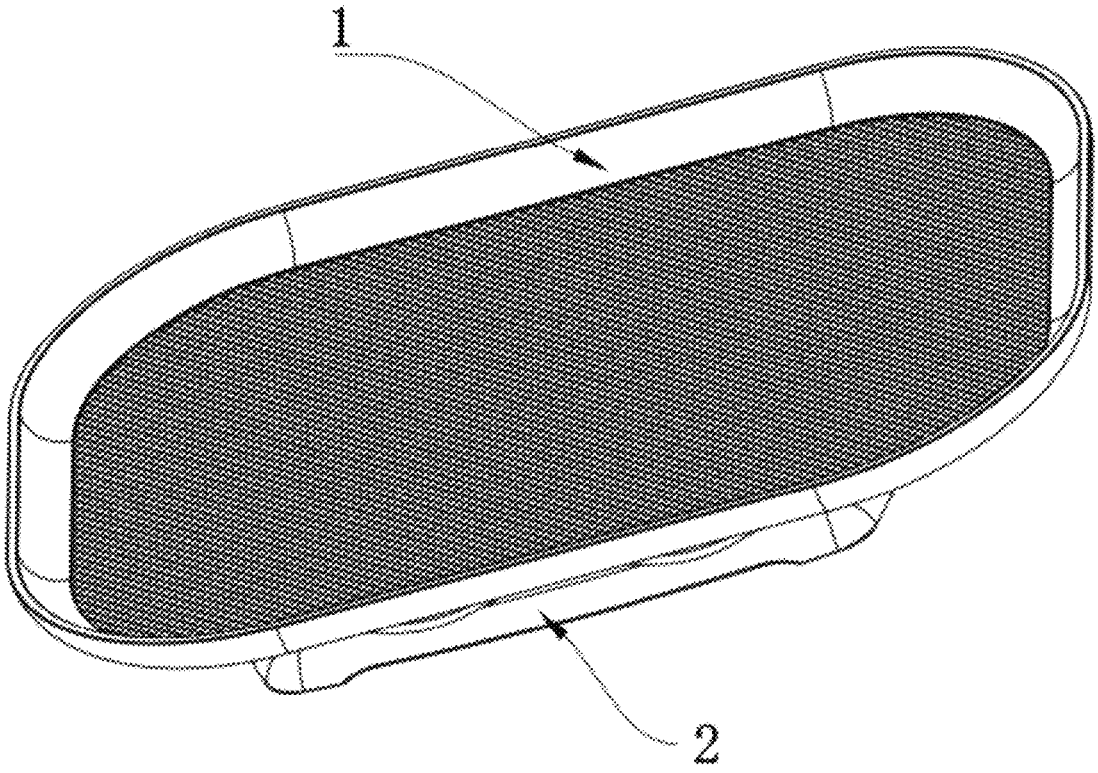
FIG. 4 is a schematic view of a turntable according an embodiment of the present application.

As shown in FIG. 4 and FIG. 6, an anti-slip structure 13 is provided on an outer surface of the tray 1 and configured as a mesh protrusion. The tray 1 is mainly used for storing items thereon. By means of setting the anti-slip structure 13 on the outer surface of the tray 1, the items are not easy to slide after being placed on the tray 1, improving placement stability and safety.

Figure 11:
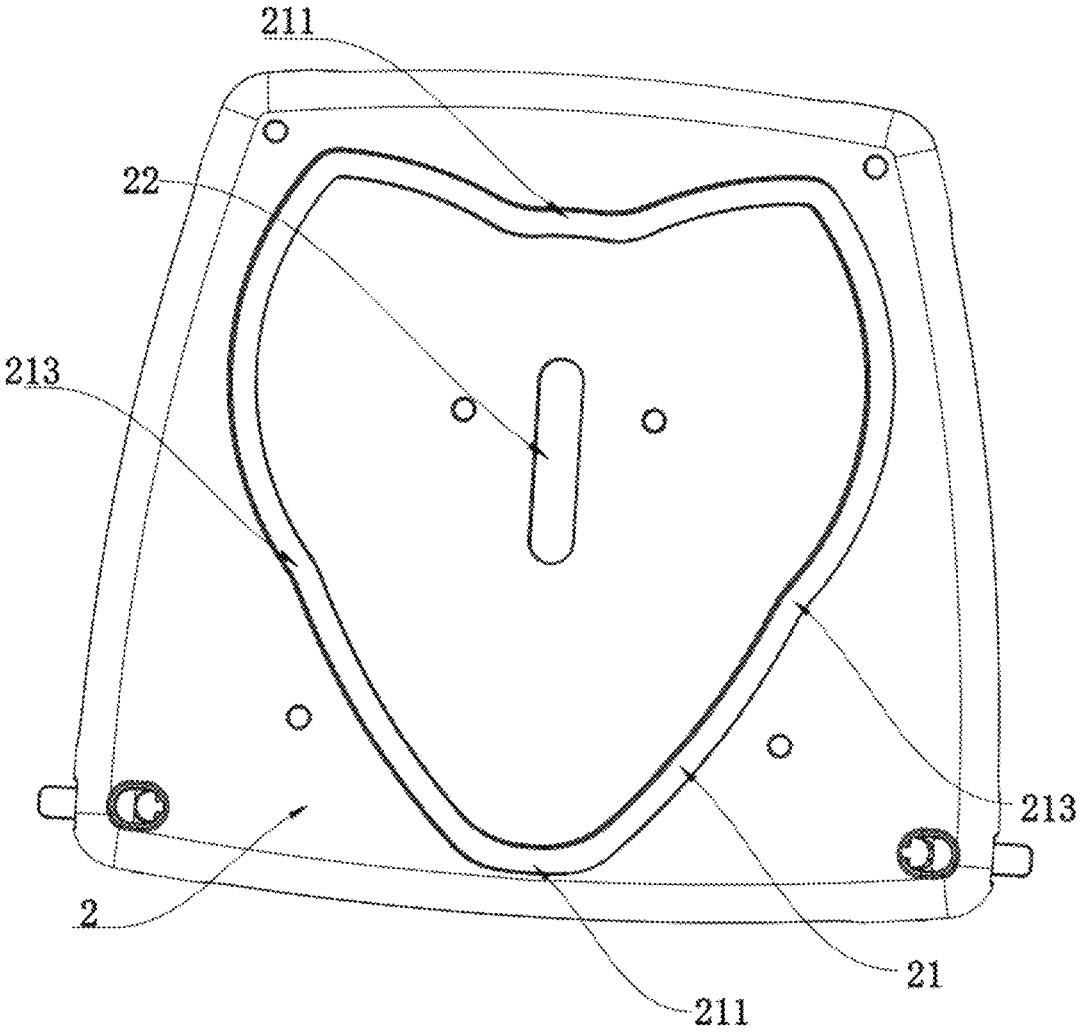
FIG. 11 is a schematic view of a specific embodiment of the base of the present application.

As shown in FIG. 11, this embodiment provides a specific heart-shaped sliding rail, wherein a head and a tail of the heart-shaped sliding rail 21 each are provided with a flat section 211 that matches with the first rod 11, making the sliding of the first rod 11 relatively smooth. Additionally, two sides of the heart-shaped sliding rail 21 each are provided with a concave section 213 that matches with the first rod 11, making the sliding of the first rod 11 less likely to jam. In addition, the concave sections 213 also facilitate position of the tray 1 when it is longitudinally placed on the base 2, further improving the user experience.

Figure 12:
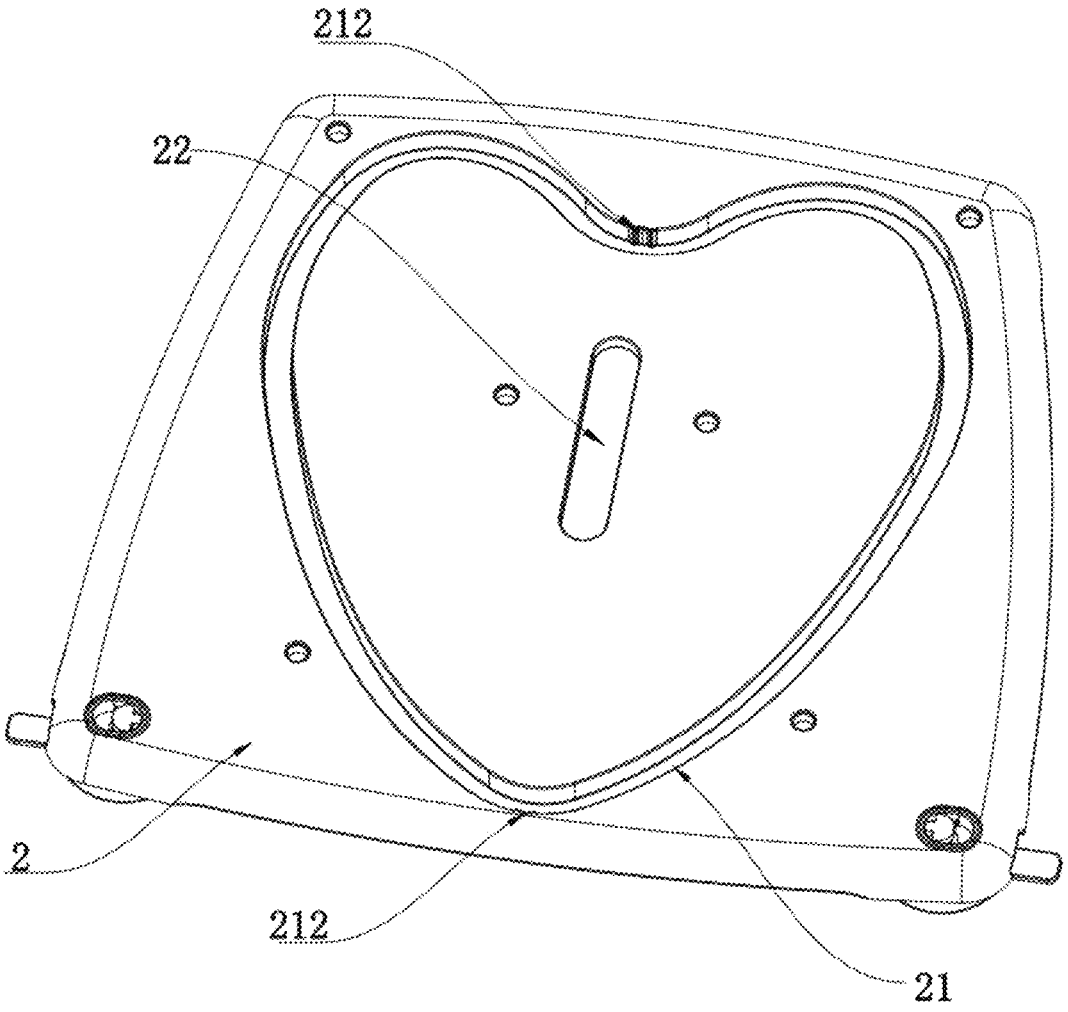
FIG. 12 is a schematic view of another specific embodiment of the base of the present application.

As shown in FIG. 12, this embodiment provides another specific heart-shaped sliding rail, wherein the head and tail of the heart-shaped sliding rail 21 each are provided with a position structure 212 that matches with the first rod 11. In this embodiment, the position structure 212 is configured as a position groove. In other embodiment, any position solution suitable to the present application may be used. Under the action of the position structure 212, when the first rod 11 slide to the head/tail of the heart-shaped sliding rail 21, position of the tray 1 when it is transversely placed on the base 2 is facilitated.

This embodiment further discloses a storage cabinet, such as a cabinet, refrigerator, etc. The storage cabinet includes the aforementioned turntable, which is installed inside the storage cabinet. Users can store items on the turntable, and the items placed on the rear side can be rotated to the front side for retrieval by rotating the tray 1, thereby achieving getting the items by a single hand, which is labor-saving and convenient to use.

Further, in some embodiments, the partition of the storage cabinet may be set as the base 2. That is, the heart-shaped sliding rail 21 and straight sliding rail 22 may be directly formed on the partition, which makes the storage cabinet more compact in its height direction and is conducive to reducing height waste.

The present application is not limited to the above preferred embodiments. Anyone can derive various other forms of products from the inspiration of this application, but regardless of any changes in its shape or structure, any technical solution that is the same or similar to this application falls within the protection scope of this application.

What is claimed is:

1. A turntable, comprising a tray and a base, a heart-shaped sliding rail and a straight sliding rail being provided on the base, wherein the heart-shaped sliding rail surrounds the straight sliding rail;

a first rod and a second rod being provided on a bottom of the tray and arranged on a symmetrical line of the bottom of the tray, wherein the first rod is slidably matched with the heart-shaped sliding rail, and the second rod is slidably matched with the straight sliding rail;

when a position of the tray relative to the base is at an initial position, the symmetrical line of the bottom of the tray is collinear with a symmetrical line of the heart-shaped sliding rail, and the straight sliding rail extends along the symmetrical line of the heart-shaped sliding rail; and when the position of the tray relative to the base switches from the initial position to a picking position, the first rod slides along the heart-shaped sliding rail and the second rod slides along the straight sliding rail, making the tray rotate circumferentially relative to the base with an outer circumferential surface of the tray being prevented from interfering with an inner wall of a chamber which is configured for placing the turntable and thus accommodating the tray therein;

wherein a bottom surface of the base is concaved upwards to form a concave portion, the heart-shaped sliding rail is located within the concave portion, and a plurality of reinforced structures is provided on the concave portion and connected to the heart-shaped sliding rail.

2. The turntable according to claim 1, wherein the heart-shaped sliding rail is a concaved groove defined in the base, and the straight sliding rail is an elongated, strip-shaped through hole defined in the base.

3. The turntable according to claim 2, wherein the second rod extends through the straight sliding rail to connect a limiting member, and the limiting member cooperates with the straight sliding rail to keep the second rod within the straight sliding rail.

4. The turntable according to claim 3, wherein a bottom of the straight sliding rail is provided with a circumferential surface that matches with the limiting member, and the circumferential surface abuts a bottom of the limiting member.

5. The turntable according to claim 1, wherein a plurality of rolling balls is provided between the tray and the base.

6. The turntable according to claim 5, wherein the base is provided with a plurality of ball seats, and the plurality of rolling balls are mounted in the plurality of ball seats, respectively.

7. The turntable according to claim 1, wherein the straight sliding rail is provided with a limiting end, and the second rod is located at the limiting end when the position of the tray relative to the base is at the initial position.

8. The turntable according to claim 1, wherein a sucker is provided at the bottom of the base, and the sucker is provided with a handle, and an opening that matches with the handle is provided at the bottom of the base, and wherein the handle extends beyond the base through the opening.

9. The turntable according to claim 1, wherein a first bearing is provided between the first rod and the heart-shaped sliding rail, and the first rod slides inside the heart-shaped sliding rail through the first bearing; and a second bearing is provided between the second rod and the straight sliding rail, and the second rod slides inside the straight sliding rail through the second bearing.

10. The turntable according to claim 1, wherein an anti-slip structure is formed on an outer surface of the tray.

11. The turntable according to claim 1, wherein a head and a tail of the heart-shaped sliding rail each are provided with a flat section that matches with the first rod; and/or, two sides of the heart-shaped sliding rail each are provided with a concave section that matches with the first rod; and/or, the head and the tail of the heart-shaped sliding rail each are provided with a position structure that matches with the first rod.

12. A storage cabinet, comprising the turntable of claim 1.

* * * * *